United States Patent [19]

Sixsmith et al.

[11] 4,306,833

[45] Dec. 22, 1981

[54] REGENERATIVE ROTODYNAMIC MACHINES

[75] Inventors: Herbert Sixsmith, Oxford; Keith Thurlow, Nr. Ipswich; Geoffrey K. Soar; James W. Burton, both of Ipswich, all of England

[73] Assignee: CompAir Industrial Limited, Ipswich, England

[21] Appl. No.: 97,957

[22] Filed: Nov. 28, 1979

[30] Foreign Application Priority Data

Nov. 28, 1978 [GB] United Kingdom ..... 46419/78

[51] Int. Cl.[3] ..... F04D 5/00; F04D 23/00

[52] U.S. Cl. ..... 415/53 T; 415/198.2; 415/213 T

[58] Field of Search ..... 415/53 T, 198.2, 213 T

[56] References Cited

U.S. PATENT DOCUMENTS

| | | | |
|---|---|---|---|
| 1,619,285 | 3/1927 | Burks | 415/213 T |
| 1,689,579 | 10/1928 | Burks | 415/198.2 |
| 1,973,669 | 9/1934 | Spoor | 415/53 T |
| 2,426,645 | 9/1947 | Riede | 415/198.2 |
| 3,782,850 | 1/1974 | Egli et al. | 415/53 T |

FOREIGN PATENT DOCUMENTS

| | | | |
|---|---|---|---|
| 2112762 | 10/1972 | Fed. Rep. of Germany | 415/213 T |
| 2612118 | 10/1976 | Fed. Rep. of Germany | 415/53 T |

*Primary Examiner*—Louis J. Casaregola
*Attorney, Agent, or Firm*—Ira C. Edell

[57] ABSTRACT

In a regenerative rotodynamic compressor, a portion of a disc-like impeller adjacent the impeller periphery extends radially through an annular chamber in the compressor casing concentric with the impeller, thereby dividing said chamber into two annular side channels, one on each side of the impeller. The portion of the impeller lying in the annular chamber has scooped out annular cavities or recesses in its sides in which are disposed rings of aerodynamic blades, and fluid flow passing around the annular chamber from an inlet to an outlet is caused to circulate repeatedly, flowing radially outward through the blading in the impeller cavities and radially inward in the annular side channels alongside the impeller outside the impeller cavities. Shroud rings at the blade tips form cores around which this circulation takes place. The blades are cast integrally with the impeller disc or with the shroud rings. The aerodynamic blades are designed so that the angle between the entry and exit flows of each blade is greater than 90°.

15 Claims, 12 Drawing Figures

REGENERATIVE ROTODYNAMIC MACHINES

Figure 1:
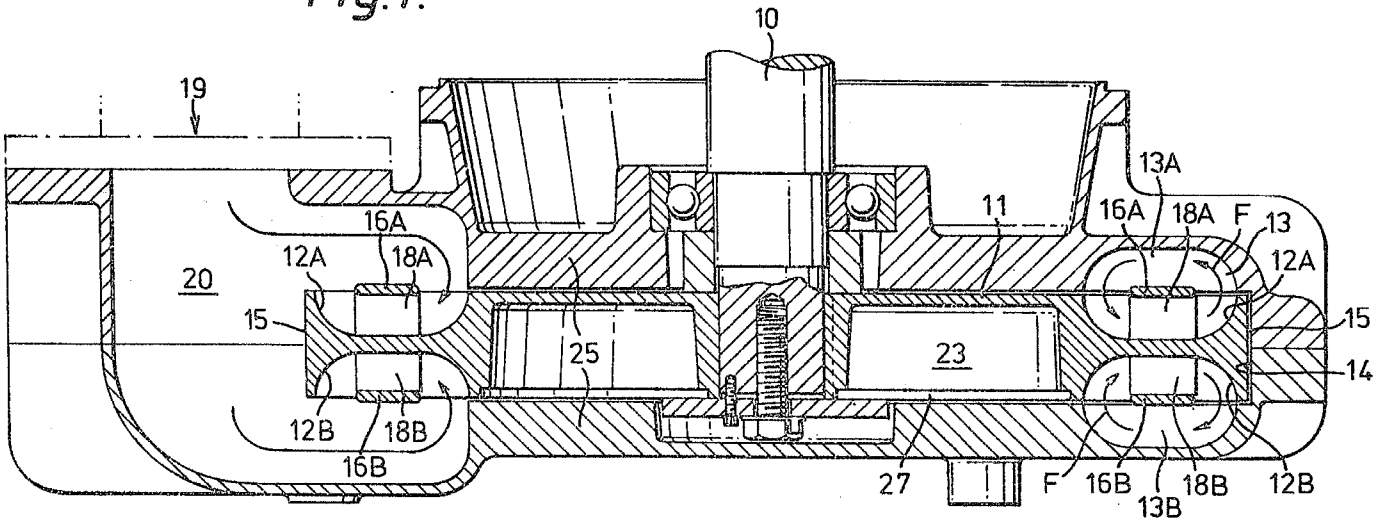

This invention relates to regenerative rotodynamic machines, and more especially to regenerative pumps and compressors.

A regenerative or peripheral pump is a rotordynamic machine which permits a head equivalent to that of several centrifugal stages to be obtained from a single rotor with comparable tip speeds. The impeller can take the form of a disc with a set of vanes projecting axially at each side near the disc periphery. Around the greater portion of the periphery the vanes project into an annular channel of which the cross sectional area is greater than that of the impeller vanes. At one selector between the inlet and discharge the annular channel is reduced to a close running clearance around the impeller. This sector is called the stripper seal and its function is to separate the inlet and discharge ports, thereby forcing the fluid out through the discharge port. The stripper allows only the fluid between the impeller vanes to pass through to the inlet.

The advantage of pumps of this type lies in the generation of a high head at low flow rates. They have a very low specific speed. Although their efficiency is not very high, being usually less than 50%, pumps of this type have found many applications in industry where it is preferred to use rotodynamic pumps in place of positive displacement pumps for duties requiring a high head at low flow rates. Their simplicity, and the absence of problems due to lubrication and wear, give advantages over positive displacement pumps, despite the lower efficiency.

The regenerative pump has been adapted for the compression of gas. The advantage lies in the low specific speed giving a high pressure ratio together with a low flow rate for a given size of machine. Further advantages are oil free operation and freedom from stall or surge instability.

In such a compressor, the gas follows a helical path through the annular channel and passes through the vanes a number of times in its peripheral path from the inlet port to the discharge port. Each passage through the vanes may be regarded as a stage of compression and thus the equivalent of several stages of compression can be obtained from a single impeller. This pumping process, however, cannot be considered as efficient. The fluid between the vanes is thrown out and across the annular channel and violent mixing occurs, the angular momentum acquired by the fluid in its passage between the vanes being transferred to the fluid in the annular channel. The mixing process is accompanied by the production of a great deal of turbulence and this implies an undesirable waste of power.

Several theories of the fluid-dynamic mechanism of a regenerative pump have been published. These theories have been reviewed and compared by Senoo (A.S.M.E. Trans. Vol. 78, 1956, pp. 1091–1102). Differences occur in the assumptions made, but in principle the various theories appear to be compatible. Senoo and Iversen (A.S.M.E. Trans. Vol. 77, 1955, pp 19–28) consider turbulent friction between the moving impeller and the fluid as the primary force causing the pumping action. Wilson, Santalo and Oelrich (A.S.M.E. Trans. Vol. 77, 1955, pp 1303–1316) regard the mechanism as based on a circulatory flow between the impeller and the fluid in the casing with an exchange of momentum between the fluid passing through the impeller and the fluid in the casing.

More recently, compressors with considerably better efficiency have been proposed in which the conventional radial vanes are replaced by aerodynamic blading. The annular channel is provided with a core to assist in guiding the fluid so that it circulates through the blading with a minimum of loss. The core also acts as a shroud closely surrounding the blades at their tips to reduce losses due to the formation of vortices at the tips of the blades. Such an arrangement is described, for instance, in British patent specification No. 1237363.

It is an object of this invention to achieve further important improvements in regenerative rotodynamic machines, and especially to make possible a range of compressors with aerodynamic blading that possess commercial advantages.

According to the present invention, in a regenerative rotodynamic machine, a rotary disc-like impeller has a portion adjacent its periphery that extends radially through an annular chamber in the casing concentric with the impeller which chamber is wider than the impeller so that an annular side channel is thereby provided in the casing on at least one side of the impeller, and radially inward of its outer peripheral surface the portion of the impeller within the annular chamber is formed, on the side where lies said annular side channel, with an annular cavity or scooped out recess in its side wall in which is disposed a ring of aerodynamic blades that have a radial extent less than the radial extent of the cavity or recess, the fluid flow passing peripherally around the annular chamber from an inlet to an outlet and also during this passage circulating a number of times radially outward through the aerodynamic blading in the impeller cavity and radially inward in the annular side channel alongside the impeller outside the cavity, the forward peripheral component of velocity of the fluid at the trailing edges of the blades being greater than the forward velocity of said trailing edges.

In the preferred embodiment, the annular chamber is divided by the impeller into two annular side channels, one on each side of the impeller, and the impeller has annular cavities, with rings of blading disposed therein, on both sides of its peripheral region. The blades being situated in scooped out recesses in the impeller gives the particular advantage that the gas flow emerging from the blading is still within these scooped out recesses and does not come into frictional contact with the stationary outer peripheral wall of the annular chamber. Therefore, friction is reduced as compared with prior machines in which the gas leaving the blading impinges directly on the stationary wall of the annular chamber. A further advantage accrues if the impeller disc complete with blading is manufactured as a single integral machine part by, for example, die-casting. A core or blade tip shroud can then be provided in the annular channel at each side of the impeller by securing a shroud ring to the tips of the blades. An alternative method of manufacture, also having advantages, is to die-cast the impeller disc without blading, and to cast the blading integrally with the shroud rings, each set of blading, complete with the respective shroud ring, being afterwards secured into the respective impeller recess or cavity.

Figure 2:
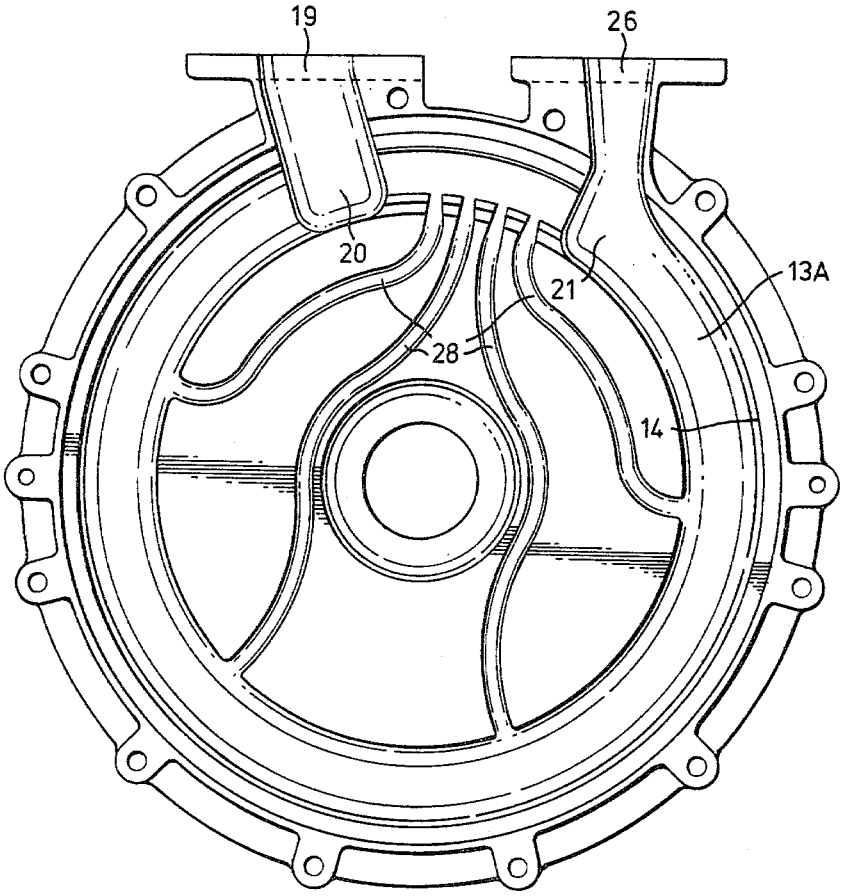
Figure 3:
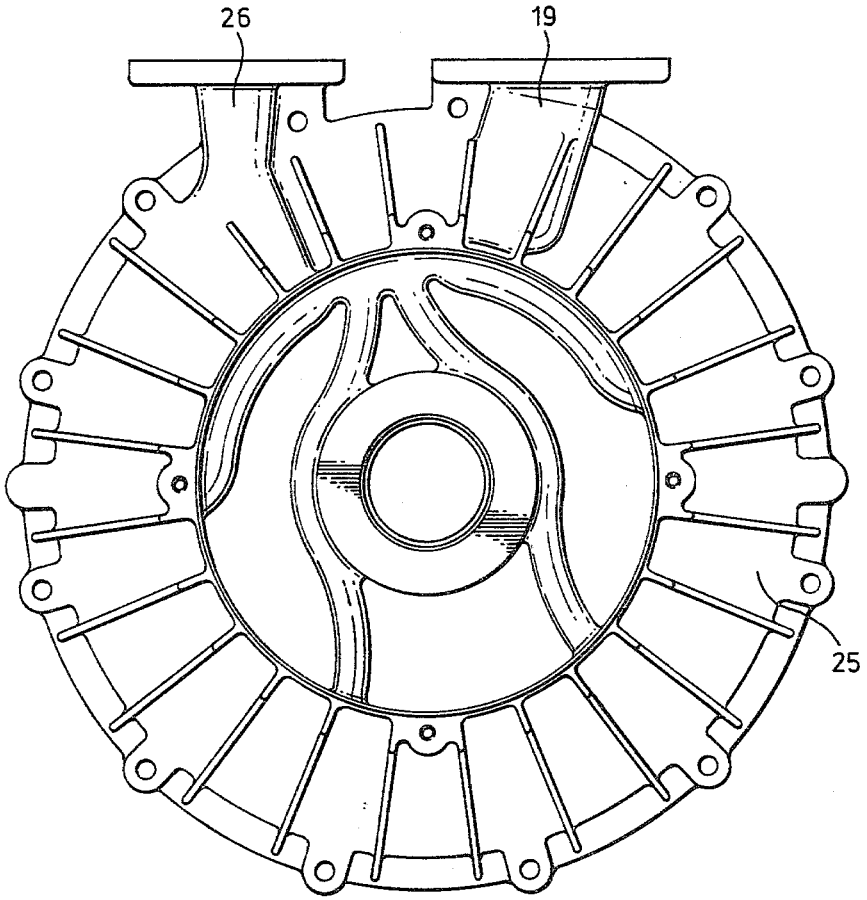
Figure 4:
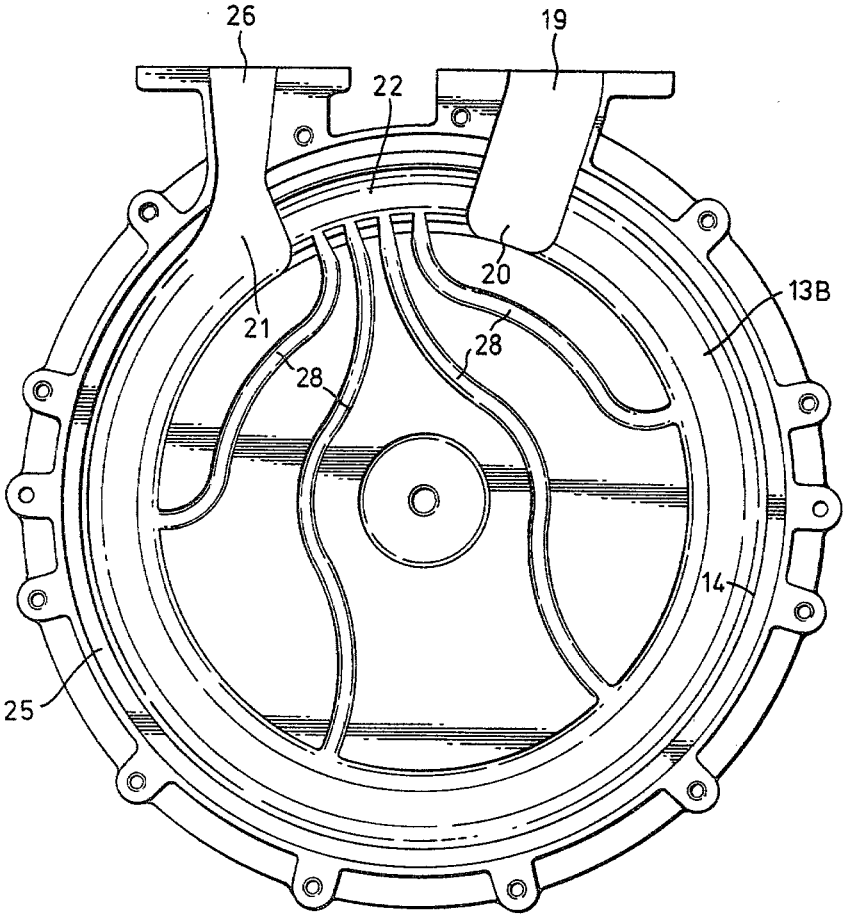
Figure 5:
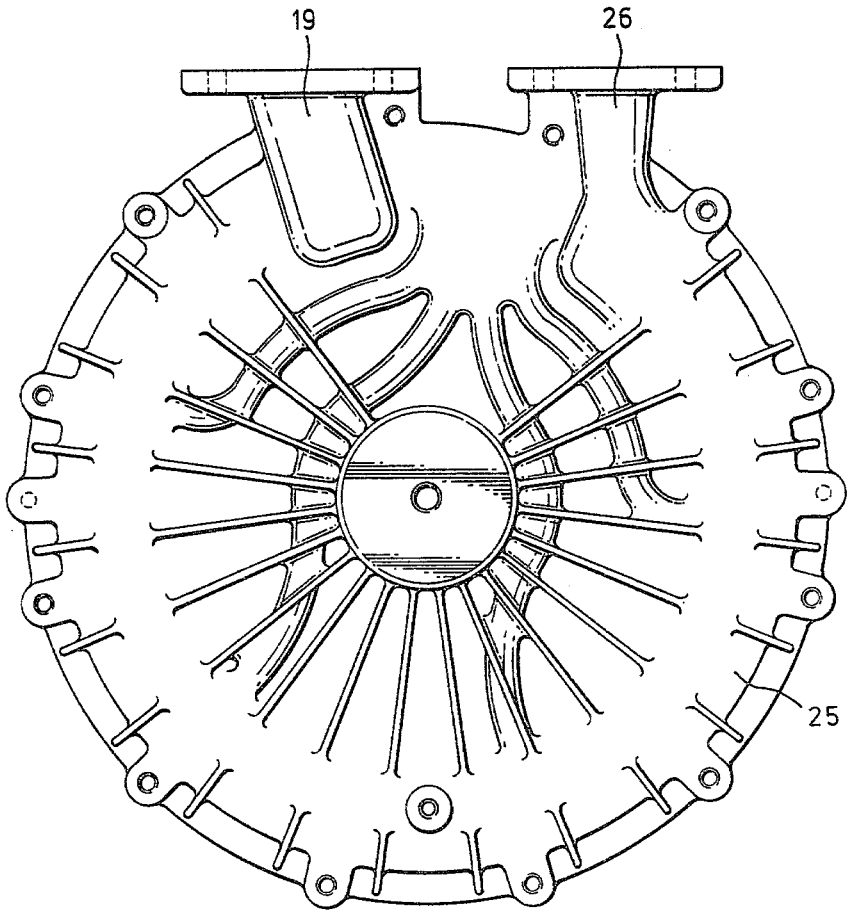
Figure 6:
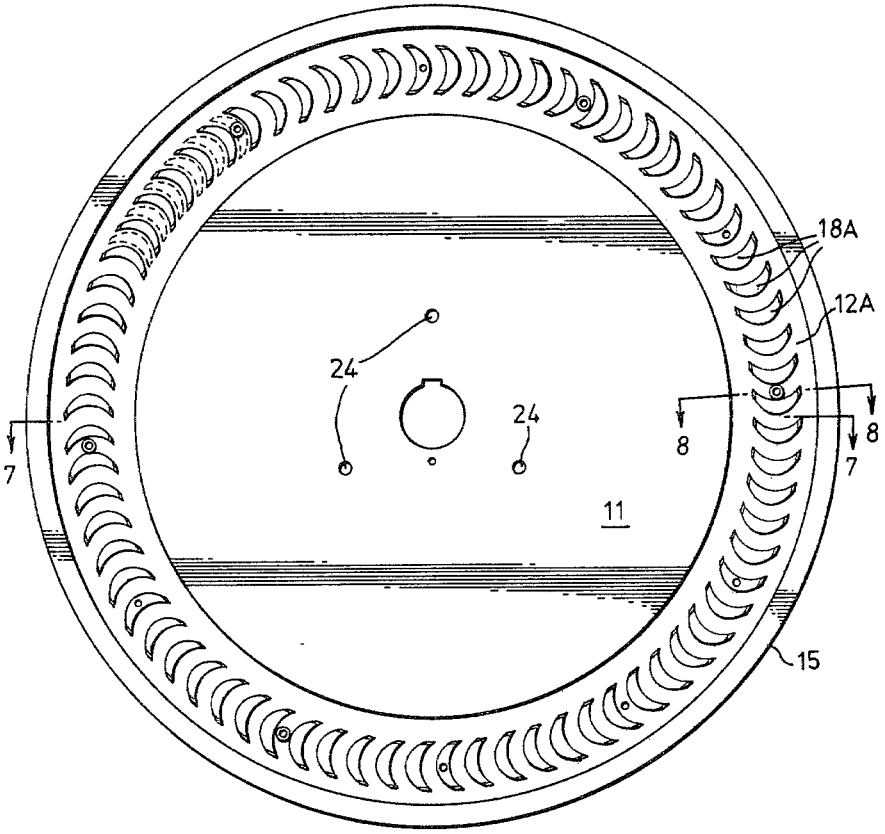
Figure 7:
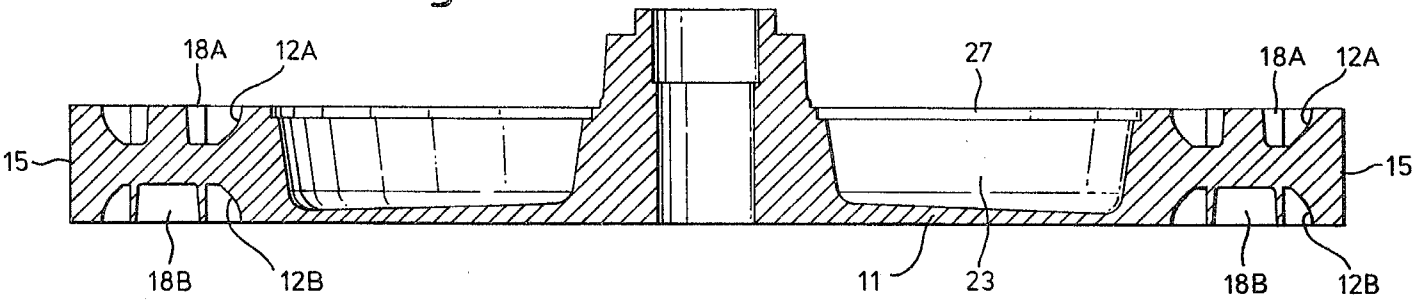
Figure 8:
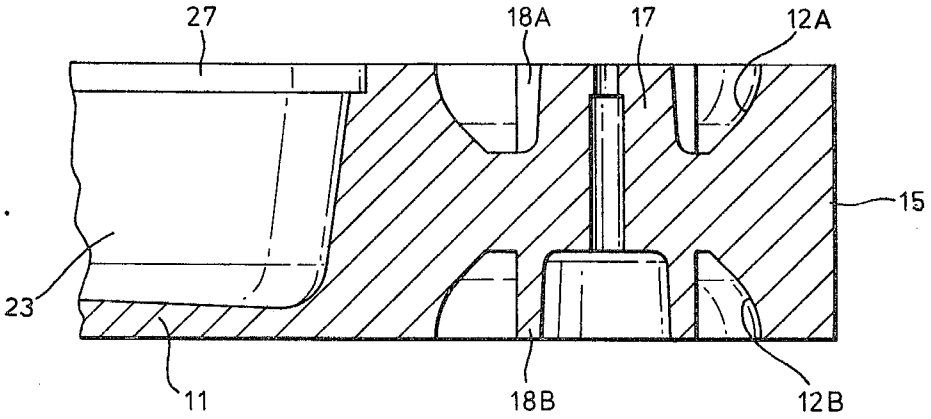
Figure 9:
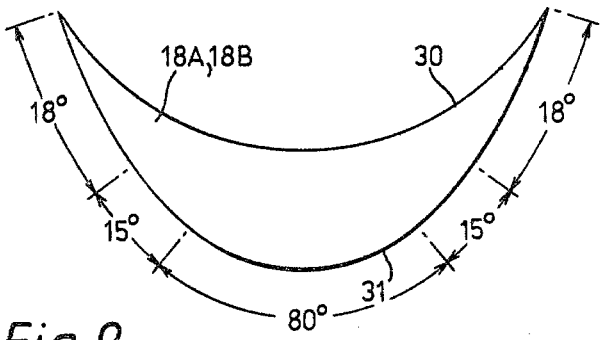
Figure 10:
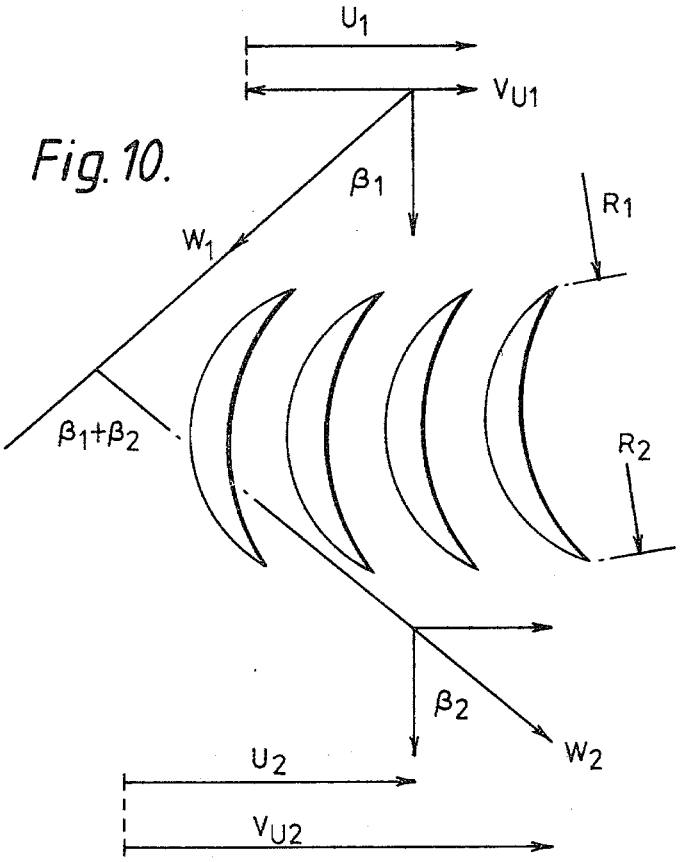
Figure 11:
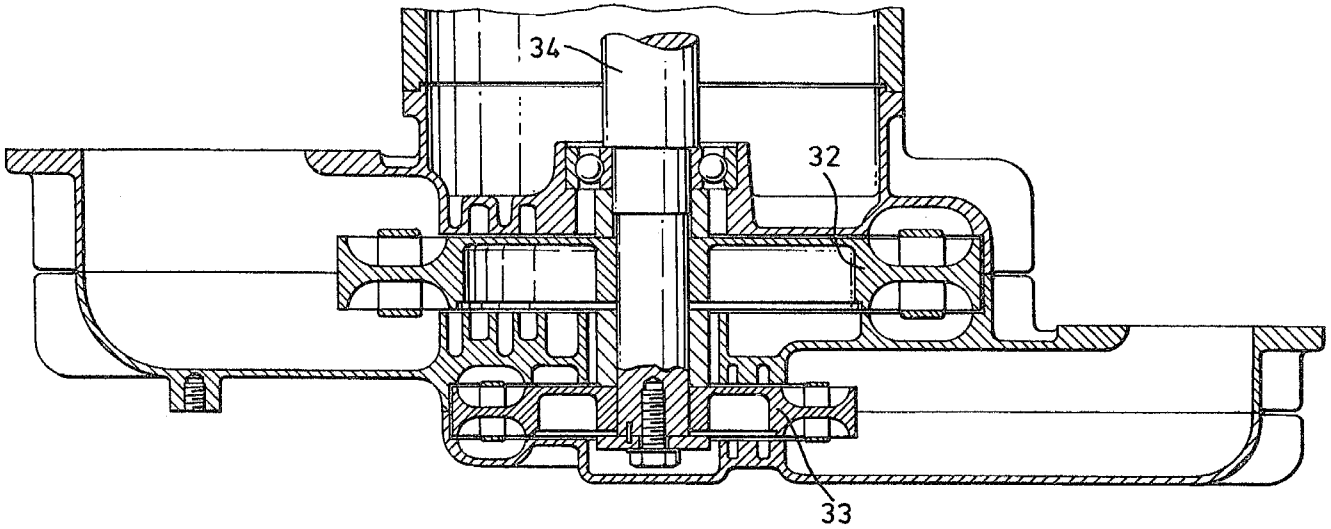
Figure 12:
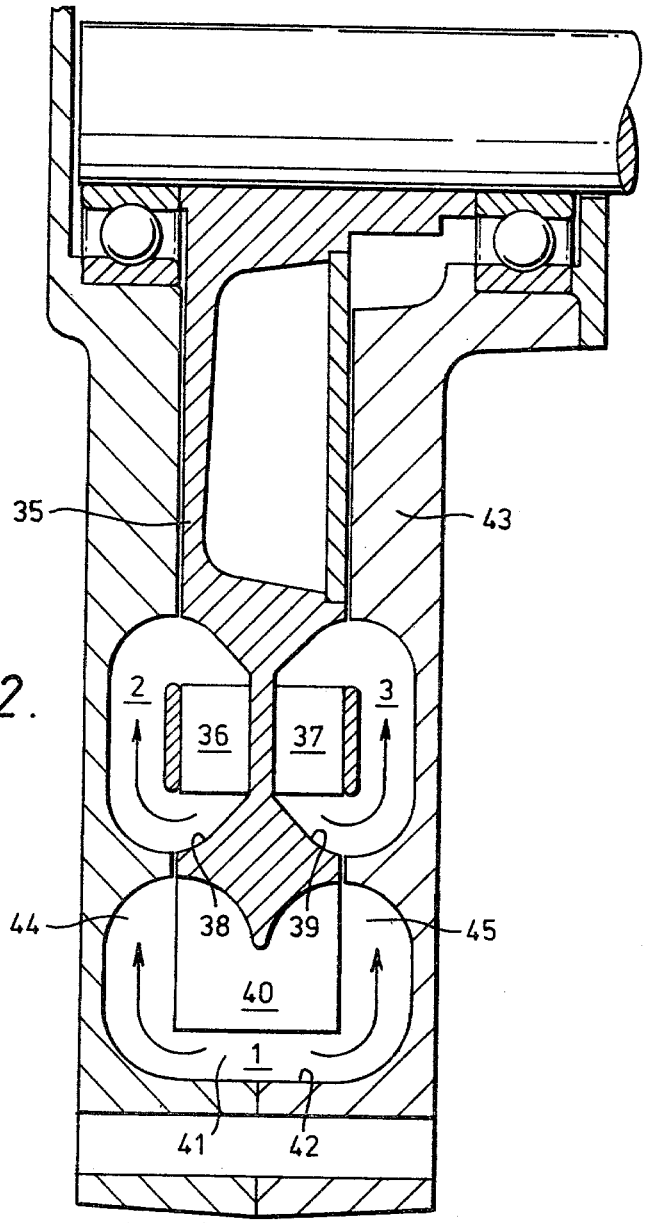

Arrangements of compressor in accordance with the invention will now be described, by way of example, with reference to the accompanying drawings, in which:

FIG. 1 is a diagrammatic cross-section of a regenerative compressor according to the invention, FIGS. 2 and 3 show, respectively, the interior and exterior of the top half of the casing of an actual compressor embodying the principles of FIG. 1, FIGS. 4 and 5 are corresponding views of the bottom half of the compressor casing, FIG. 6 is a plan view of the compressor impeller, FIGS. 7 and 8 are sectional views on the lines 7—7 and 8—8, respectively, of FIG. 6, FIG. 9 is a diagram of the areodynamic blade profile, FIG. 10 is a diagrammatic representation of the blade velocities and flow angles, FIG. 11 shows a second embodiment in which the compressor has two impellers to operate as successive stages, and FIG. 12 shows, as a third embodiment, an alternative form of multistage compressor.

In the drawings, FIG. 1 is a diagrammatic view illustrating the operation of a regenerative compressor of which the actual casing members and impeller are shown in FIGS. 2 to 8.

Referring firstly to FIG. 1, this shows diagrammatically a simple single impeller regenerative compressor according to the invention. The impeller 11 housed in a split casing 25 is driven by a shaft 10 and consists of a disc with aerodynamic blades 18A, 18B provided within scooped out regions 12A, 12B at each side of the disc just radially inward of the disc periphery. The bladed margin of the impeller projects into an annular chamber 13 in the compressor casing 25 which is wider than the impeller and has at its outer periphery an inward-facing cylindrical surface 14 which is closely approached by the cylindrical peripheral surface 15 of the impeller 11, thereby dividing the chamber 13 into two separated side channels 13A, 13B, each of roughly oval cross-section, that are located on opposite sides of the impeller disc 11 and are each defined partly by the wall of the chamber 13 and partly by the contour of the respective scooped out side portion 12A or 12B of the impeller 11 that contains the blades 18A or 18B. The blades extend approximately half-way across the respective side channel 13A, 13B and are designed to turn the fluid through an angle of well in excess of 90° as it flows radially outward through the blading, setting up a circulation in each side channel 13A, 13B as indicated by the arrows F. Each annular side channel has a central core 16A, 16B to assist in guiding the fluid so that it circulates through the blading with a minimum of loss. Each core 16A, 16B is in the form of a shroud ring placed against the blade tips to eliminate loss due to formation of vortices at the tips of the blades. The shround rings 16A, 16B are secured to the impeller blades 18A, 18B by screws locating in bosses 17 on the impeller (FIG. 8). Alternatively, the shroud rings may be stationary and supported on a number of small pillars bolted to the sides of the casing.

The fluid enters the annular chamber 13 through a port 19 in the wall of the casing 25 which leads to an inlet chamber 20 communicating with both of the channels 13A, 13B at their outer peripheries. The fluid leaves the annular channels 13A, 13B through an outlet 21 (FIGS. 2 to 5) which is followed by a conical diffuser 26 to obtain pressure recovery. Between the inlet and outlet, the stripper seal 22 (FIGS. 2 and 4) is formed by shaping the interior of the casing walls so that they approach closely to the sides of the impeller all the way out of its periphery 15. Alternatively, the stripper seal can be formed by the addition of a completely separate stripper element. Such high pressure gas is then trapped in the scooped cavities 12A, 12B of the impeller, relieving passages 28 are provided in the casing walls that communicate with the chamber 13 at various locations.

Radially inward of the scooped cavities 12A, 12B and blading 18A, 18B, the impeller 11 is formed as an annular dish, with a hollow interior 23 closed by an annular plate 27, as seen in FIGS. 1 and 7. Since gas may creep down one side of the impeller more than the other and create a pressure differential across the rotor disc, pressure equalising holes 24 are provided.

Between the inlet and outlet ports 19, 21 the fluid being compressed passes a number of times through the blading 18A, 18B. During each passage a quantity of energy is transferred from the impeller to the fluid. The rate of flow through the blading is self-adjusting in the sense that the velocity through the blade channels tends to increase until the rate of energy transfer reaches the value needed to generate the pressure difference between the inlet and outlet ports. An increase in the pressure difference causes corresponding increases in both the number of passages through the blading and the energy transferred at each passage. The rate of energy transfer tends to vary as the square of the velocity relative to the blades. By equating the power transferred from the blading to the fluid with the power needed to generate the pressure difference across the inlet and outlet ports, the flow velocities in the annular channels 13A, 13B can be estimated. This information serves as a useful guide towards the optimum design of the blading.

Referring to FIG. 10, it is seen that the fluid enters and leaves the blading with relative velocities $W_1$ and $W_2$ and with inlet and outlet fluid angles of $\beta_1$ and $\beta_2$. If $V_{U1}$ and $V_{U2}$ are, respectively, the peripheral components of the absolute velocities of the fluid at the leading and trailing edges of the blading, and $U_1$ and $U_2$ are the peripheral velocities of the leading and trailing edges, then:

$$V_{U1} = U_1 - W_1 \sin \beta_1$$

$$V_{U2} = U_2 + W_2 \sin \beta_2$$

The peripheral or forward component of velocity of the gas on leaving the blades is greater than the blade velocity. As soon as the gas emerges from the blades, it comes under the influence of the peripheral pressure gradient and during its transverse passage arouund the annular channel its peripheral velocity is progressively reduced until it re-enters the blading to receive another impulse. As seen in FIG. 9, for ease of manufacture the surfaces of the aerodynamic blades 12A, 12B are formed of successions of circular arcs. In the example illustrated, the inner surface 30 of the blade is formed as a single arc while the outer surface 31 is formed as a central 80° arc flanked by two 15° arcs and then two 18° arcs.

In the illustrated embodiments, the aerodynamic blades 18A, 18B are die-cast integrally with the impeller disc 11. However, as already indicated, a possible alternative is to die-cast the impeller disc with empty cavities 12A, 12B and to form the blading separately, each set of blading being cast integrally with its respective shroud ring 16A or 16B and afterwards secured, e.g. by screws, into the appropriate cavity 12A or 12B.

Two or more impellers can be mounted on a common drive shaft to provide a multi-stage or multi-banked compressor. FIG. 11 shows a compressor with two impellers 32, 33 of different sizes on a common drive shaft 34.

However, a more interesting possibility is the arrangement shown in FIG. 12, in which a single impeller 35 carries, radially inward of its periphery, two sets of blading 36, 37 disposed in side cavities 38, 39 (similarly to the blading 18A, 18B of the embodiment of FIG. 2 to 8) and, in addition, further blading 40 formed at its periphery. In this case, a gap 41 exists between the impeller periphery and the inner circumferential wall 42 of the casing 43, uniting the two annular side channels 44, 45 at opposite sides of the impeller rim.

Such a machine can be staged in any desired manner. That is to say, the fluid being compressed can be passed in succession through the three sets of blading 36, 37, 40 in any order. In the example illustrated, the circled numbers 1, 2 and 3 indicate that the order proposed is that the fluid shall be compressed first by the peripheral blading 40, then by one set of side blading 36 and thirdly by the other set of side blading 37.

Whereas the machines shown in the drawings have double-sided impellers, it will be understood that it is possible to have blading only on one side. By employing a split impeller built up from two halves a range of capacities readily becomes available using only two kinds of impeller casting. Thus, half the capacity of a double-sided impeller is obtained by fixing together a bladed half-impeller and a blank half, twice the capacity is obtained from two double-sided impellers in bank, and 1½ times the capacity is given by two impellers one of which has a blank side.

Machines according to the invention are balanced and vibration free and, being comparatively inexpensive to build, provide a quieter alternative to the Roots blower. Existing regenerative compressors are equally smooth running but not so efficient. Thus, such prior machines give a maximum of 8 p.s.i. in one stage whereas machines according to the invention will give 10 p.s.i. and upwards, and also can be employed to pull a vacuum. A machine such as that shown in FIGS. 2 to 8 is particularly easy to manufacture, the parts being formed by simple die-casting, and, as already explained, friction is reduced at the periphery of the impeller.

We claim:

1. A regenerative rotodynamic machine, wherein a rotary disc-like impeller has a portion adjacent its periphery that extends radially through an annular chamber in the casing concentric with the impeller which chamber is wider than the impeller so that an annular side channel is thereby provided in the casing on at least one side of the impeller, and radially inward of its outer peripheral surface the portion of the impeller within the annular chamber is formed, on the side where lies said annular side channel, with an annular cavity or scooped out recess in its side wall in which is disposed a ring of aerodynamic blades that have a radial extent less than the radial extent of the cavity or recess, the fluid flow passing peripherally around the annular chamber from an inlet to an outlet and also during this passage circulating a number of times radially outward through the aerodynamic blading in the impeller cavity and radially inward in the annular side channel alongside the impeller outside the cavity, the forward peripheral component of velocity of the fluid at the trailing edges of the blades being greater than the forward velocity of said trailing edges.

2. A machine according to claim 1, wherein a shroud ring is disposed adjacent to the blade tips of the ring of aerodynamic blades, the shroud ring constituting a core within the annular channel around which the fluid circulates.

3. A machine according to claim 2, wherein the shroud ring is secured to the blades and rotates with the impeller.

4. A machine according to claim 2, wherein the shroud ring is stationary, being mounted in the casing.

5. A machine according to claim 1 wherein the aerodynamic blades are cast integrally with the impeller.

6. A machine according to claim 2, wherein the blades are cast integrally with the shroud ring, and separately from the impeller, the shroud ring and blades being secured to the impeller.

7. A machine according to claims, 1, 2, 3, 4, 5 or 6, wherein the annular chamber is divided by the impeller into two annular side channels, one on each side of the impeller, and the impeller bears two rings of aerodynamic blades disposed in respective cavities or recesses in opposite sides of the impeller.

8. A machine according to claims 1, 2, 3, 4, 5 or 6, wherein the outer peripheral surface of the impeller is in close running clearance with the inward facing outer peripheral wall of the casing.

9. A machine according to claims 1, 2, 3, 4, 5 or 6, wherein the aerodynamic blades have an angle between the entry and exit flows of each blade greater than 90°.

10. A machine according to claim 1, wherein a sector of the annular chamber between the inlet and the outlet is occupied by a stripper seal, and relieving passages are provided in the casing between the stripper seal sector of the annular chamber and other locations around the annular chamber remote from the stripper seal.

11. A machine according to claim 10, having a split casing and wherein the stripper seal is cast integrally with the parts of the casing.

12. A machine according to claim 10, wherein the stripper seal is formed by an insert piece or pieces secured in the sector of the annular chamber between the inlet and outlet.

13. A machine according to claims 1, 2, 3, 4, 5 or 6, wherein the impeller is provided with two rings of aerodynamic blades in respective annular scoop recesses in opposite sides of the impeller, and a third ring of blades at the impeller periphery operating in a further annular channel in the casing.

14. A machine according to claims 1, 2, 3, 4, 5 or 6, wherein each curved surface of each aerodynamic blade is formed from one or more circular arcs.

15. A machine according to claims 1, 2, 3, 4, 5 or 6, comprising two impellers, of the same or different sizes, on a common shaft, each impeller bearing at least one ring of aerodynamic blades disposed in a scoop recess in the side of the impeller and operating in a respective annular channel in the casing.

* * * * *